US011328691B2

(12) United States Patent
Yoo et al.

(10) Patent No.: US 11,328,691 B2
(45) Date of Patent: May 10, 2022

(54) METHOD OF DISPLAYING IMAGE ON DISPLAY PANEL, METHOD OF DRIVING DISPLAY PANEL INCLUDING THE SAME AND DISPLAY APPARATUS PERFORMING THE SAME

(71) Applicant: Samsung Display Co., Ltd., Yongin-Si (KR)

(72) Inventors: Hyunseuk Yoo, Seoul (KR); Hyungjin Kim, Seoul (KR); Hye-Sang Park, Cheonan-si (KR); Heechul Hwang, Suwon-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/142,300

(22) Filed: Jan. 6, 2021

(65) Prior Publication Data

US 2021/0312883 A1 Oct. 7, 2021

(30) Foreign Application Priority Data

Apr. 3, 2020 (KR) ..... 10-2020-0040820

(51) Int. Cl.
*G09G 5/10* (2006.01)

(52) U.S. Cl.
CPC ..... *G09G 5/10* (2013.01); *G09G 2300/0819* (2013.01); *G09G 2310/027* (2013.01);
(Continued)

(58) Field of Classification Search
CPC .. G09G 3/2011; G09G 3/36; G09G 2300/819; G09G 2310/027;
(Continued)

(56) References Cited

U.S. PATENT DOCUMENTS

2004/0109091 A1* 6/2004 Park ..... G06T 5/40 348/673
2015/0116387 A1* 4/2015 Jun ..... G09G 3/20 345/694

FOREIGN PATENT DOCUMENTS

KR 10-2015-0048394 A 5/2015

OTHER PUBLICATIONS

Hyunseuk Yoo, Hyesang Park, Heechul Hwang and Bonghyun You, "Pixel-Wise Mura Compensation Based on Probability Theory for TV Application", Symposium topic: Display Electronics, 3 pages, Samsung Display Co., Ltd, Yongin-si, Gyeonggi-do, Republic of Korea.

* cited by examiner

*Primary Examiner* — Mihir K Rayan
(74) *Attorney, Agent, or Firm* — Innovation Counsel LLP

(57) ABSTRACT

A method of displaying an image on a display panel includes displaying an image of a grayscale value A, imaging the image of the grayscale value A with a camera, displaying an image of a grayscale value B, imaging the image of the grayscale value B with the camera, determining a compensation parameter P of the grayscale value A for each pixel in the display panel using the imaged data of the grayscale value A, determining a representative value Q of probability distribution of the compensation parameters of the grayscale value A from the image of the grayscale value A, determining a representative value R of probability distribution of compensation parameters of the grayscale value B from the image of the grayscale value B and compensating an input image data for each pixel using the value P, the value Q and the value R.

20 Claims, 11 Drawing Sheets

(52) U.S. Cl.
CPC ..... *G09G 2320/0233* (2013.01); *G09G 2320/0693* (2013.01); *G09G 2360/141* (2013.01); *G09G 2360/147* (2013.01)

(58) Field of Classification Search
CPC ... G09G 2320/0233; G09G 2320/0285; G09G 2320/0693; G09G 2360/141; G09G 2360/147
See application file for complete search history.

METHOD OF DISPLAYING IMAGE ON DISPLAY PANEL, METHOD OF DRIVING DISPLAY PANEL INCLUDING THE SAME AND DISPLAY APPARATUS PERFORMING THE SAME

PRIORITY STATEMENT

This application claims priority under 35 U.S.C. § 119 to Korean Patent Application No. 10-2020-0040820, filed on Apr. 3, 2020 in the Korean Intellectual Property Office KIPO, the contents of which are herein incorporated by reference in their entireties.

BACKGROUND

1. Field

Example embodiments of the present inventive concept relate to a method of displaying an image on a display panel, a method of driving the display panel including the method and a display apparatus performing the method. More particularly, example embodiments of the present inventive concept relate to a method of displaying an image on a display panel capable of effectively compensating the stain without increasing a capacity of a memory, a method of driving the display panel including the method and a display apparatus performing the method.

2. Description of the Related Art

Generally, a display apparatus includes a display panel and a display panel driver. The display panel displays an image based on input image data. The display panel includes a plurality of gate lines, a plurality of data lines and a plurality of pixels. The display panel driver includes a gate driver providing gate signals to the gate lines, a data driver providing data voltages to the data lines and a driving controller controlling the gate driver and the data driver.

A luminance uniformity of the display panel may be deteriorated due to a process variation of the display panel. The driving controller may compensate a stain to enhance the luminance uniformity of the display panel. When image data for one grayscale level is used for the stain compensation, an accuracy of the stain compensation may decrease. When image data for plural grayscale levels are used for the stain compensation, an increased capacity of a memory may be required.

SUMMARY

Example embodiments of the present inventive concept provide a method of displaying an image on a display panel capable of effectively compensating the stain and reducing a capacity of a memory.

Example embodiments of the present inventive concept also provide a method of driving the display panel including the method of displaying an image on the display panel.

Example embodiments of the present inventive concept also provide a display apparatus performing the method of driving the display panel.

In an example embodiment of a method of displaying an image on a display panel according to the present inventive concept includes displaying an image of a grayscale value A on the display panel, imaging the image of the grayscale value A on the display panel with a camera, displaying an image of a grayscale value B on the display panel, imaging the image of the grayscale value B on the display panel with the camera, determining a compensation parameter (a value P) of the grayscale value A for each pixel in the display panel using the imaged data of the grayscale value, determining a representative value (a value Q) of a probability distribution of the compensation parameters of the grayscale value A from the imaged data of the grayscale value A, determining a representative value (a value R) of a probability distribution of compensation parameters of the grayscale value B from the imaged data of the grayscale value B and compensating an input image data for each pixel using the value P, the value Q and the value R.

In an example embodiment, when an input grayscale value of the input image data is equal to or less than the grayscale value A, the input image data may be compensated using the value P.

In an example embodiment, when the input grayscale value of the input image data is greater than the grayscale value A and equal to or less than the grayscale value B, a compensation parameter for the input grayscale value is predicted using the value P, the value Q and the value R and the input image data may be compensated using the predicted compensation parameter for the input grayscale value.

In an example embodiment, when the input grayscale value of the input image data is greater than the grayscale value B, the compensation parameter of the grayscale value B is predicted using the value P, the value Q and the value R and the input image data may be compensated using the predicted compensation parameter of the grayscale value B.

In an example embodiment, the value Q may include an average of the compensation parameters of the grayscale value A and a standard deviation of the compensation parameters of the grayscale value A.

In an example embodiment, the value R may include an average of the compensation parameters of the grayscale value B and a standard deviation of the compensation parameters of the grayscale value B.

In an example embodiment, the compensating the input image data may include comparing a probability density function of the compensation parameters of the grayscale value A and a probability density function of the compensation parameters of a grayscale value T, when an input grayscale value of the input image data is the grayscale value T.

In an example embodiment, when the compensation parameter of the grayscale value A is xA, the average of the compensation parameters of the grayscale value A is μA, the standard deviation of the compensation parameters of the grayscale value A is σA, an average of the compensation parameters of the grayscale value T is μT, a standard deviation of the compensation parameters of the grayscale value T is σT and a predicted compensation parameter of the input grayscale value is xT, $$xT = \left(\frac{xA - \mu A}{\sigma A}\right)\sigma T + \mu T.$$

In an example embodiment, an average of the compensation parameters of the grayscale value T may be determined by interpolating the average of the compensation parameters of the grayscale value A and the average of the compensation parameters of the grayscale value B. A standard deviation average of the compensation parameters of the grayscale value T may be determined by interpolating the standard deviation of the compensation parameters of the grayscale value A and the standard deviation of the compensation parameters of the grayscale value B.

In an example embodiment, the compensation parameter of the grayscale value T may be determined by interpolating the compensation parameter of the grayscale value A and the compensation parameter of the grayscale value B.

In an example embodiment, the input image data may be compensated using the value P, values Qs corresponding to a plurality of areas and values Rs corresponding to the plurality of the areas.

In an example embodiment, the value Q of a first position in the display panel may be determined by interpolating the values Qs of areas adjacent to the first position. The value R of the first position in the display panel may be determined by interpolating the values Rs of the areas adjacent to the first position.

In an example embodiment of a method of driving a display panel according to the present inventive concept includes compensating an input image data using a compensation parameter (a value P) of a grayscale value A, a representative value (a value Q) of a probability distribution of the compensation parameters of the grayscale value A and a representative value (a value R) of a probability distribution of compensation parameters of a grayscale value B to generate a data signal, converting the data signal into a data voltage and outputting the data voltage to the display panel.

In an example embodiment, when an input grayscale value of the input image data is equal to or less than the grayscale value A, the input image data may be compensated using the value P.

In an example embodiment, when the input grayscale value of the input image data is greater than the grayscale value A and equal to or less than the grayscale value B, a compensation parameter for the input grayscale value is predicted using the value P, the value Q and the value R and the input image data may be compensated using the predicted compensation parameter for the input grayscale value.

In an example embodiment, when the input grayscale value of the input image data is greater than the grayscale value B, the compensation parameter of the grayscale value B is predicted using the value P, the value Q and the value R and the input image data may be compensated using the predicted compensation parameter of the grayscale value B.

In an example embodiment of a display apparatus according to the present inventive concept includes a display panel, a driving controller and a data driver. The driving controller is configured to compensate an input image data using a compensation parameter (a value P) of a grayscale value A, a representative value (a value Q) of a probability distribution of the compensation parameters of the grayscale value A and a representative value (a value R) of a probability distribution of compensation parameters of a grayscale value B to generate a data signal. The data driver is configured to convert the data signal into a data voltage and output the data voltage to the display panel.

In an example embodiment, the driving controller may be configured to compare a probability density function of the compensation parameters of the grayscale value A and a probability density function of the compensation parameters of a grayscale value T, when an input grayscale value of the input image data is the grayscale value T.

In an example embodiment, the driving controller may include an interpolator configured to receive the value Q and the value R from a memory and output the value Q and a representative value of probability distribution of the compensation parameters of the grayscale value T, a compensation parameter calculator configured to predict a compensation parameter of the grayscale value T using the value P, the value Q and the representative value of probability distribution of compensation parameters of the grayscale value T and a compensator configured to compensate the input image data using the compensation parameter of the grayscale value T.

In an example embodiment, the driving controller may include an area interpolator configured to receive values Qs corresponding to a plurality of areas and values Rs corresponding to the plurality of the areas from a memory and determine the value Q of a first area in the display panel and the value R of the first area in the display panel, a grayscale value interpolator configured to receive the value Q of the first area and the value R of the first area, and output the value Q of the first area and a representative value of the compensation parameters of the grayscale value T, a compensation parameter calculator configured to predict a compensation parameter of the grayscale value T using the value P, the value Q of the first area and the representative value of compensation parameters of the grayscale value T and a compensator configured to compensate the input image data using the compensation parameter of the grayscale value T.

According to the method of displaying an image on the display panel, the method of driving the display panel and the display apparatus, the input grayscale value of the input image data may be compensated using the compensation parameter of grayscale value A, the representative value of the compensation parameters of grayscale value A and the representative value of the compensation parameters of grayscale value B. The compensation parameters of grayscale value B may not be directly stored in the memory but the representative value of the compensation parameters of grayscale value B may be stored in the memory so that the accuracy of the stain compensation may be enhanced without significantly increasing the capacity of the memory.

BRIEF DESCRIPTION OF THE DRAWINGS

The above and other features and advantages of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
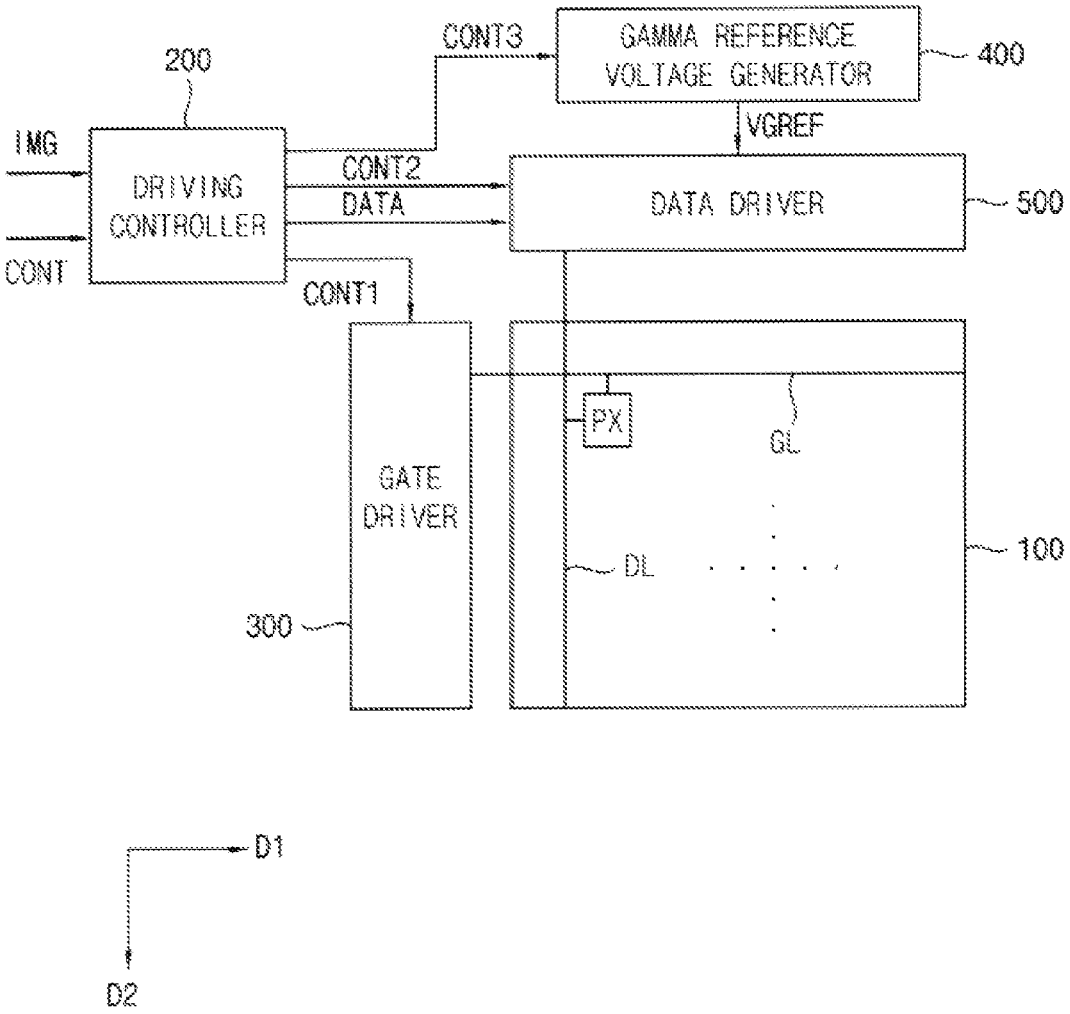
FIG. 1 is a block diagram illustrating a display apparatus according to an example embodiment of the present inventive concept.

FIG. 1 is a block diagram illustrating a display apparatus according to an example embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500.

The driving controller 200 and the data driver 500 may be integrally formed. The driving controller 200, the gamma reference voltage generator 400 and the data driver 500 may be integrally formed. A data driver which includes the driving controller 200 and the data driver 500 embedded in one chip may be called to a timing controller embedded data driver (TED).

The display panel 100 has a display region on which an image is displayed and a peripheral region adjacent to the display region.

The display panel 100 includes a plurality of gate lines GL, a plurality of data lines DL and a plurality of pixels PX connected to the gate lines GL and the data lines DL. The gate lines GL extend in a first direction D1 and the data lines DL extend in a second direction D2 crossing the first direction D1.

The driving controller 200 receives input image data IMG and an input control signal CONT from an external apparatus (not shown). The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 may compensate a stain of the display panel 100 to enhance a luminance uniformity of the display panel 100.

A structure and an operation of the driving controller 200 are explained referring to FIGS. 2 to 11 in detail.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. The gate driver 300 may be mounted on the peripheral region of the display panel 100. However, the gate driver 300 may be integrated on the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be disposed in the driving controller 200, or in the data driver 500.

The data driver 500 receives the second control signal CONT2 and the data signal DATA from the driving controller 200 and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

Figure 2:
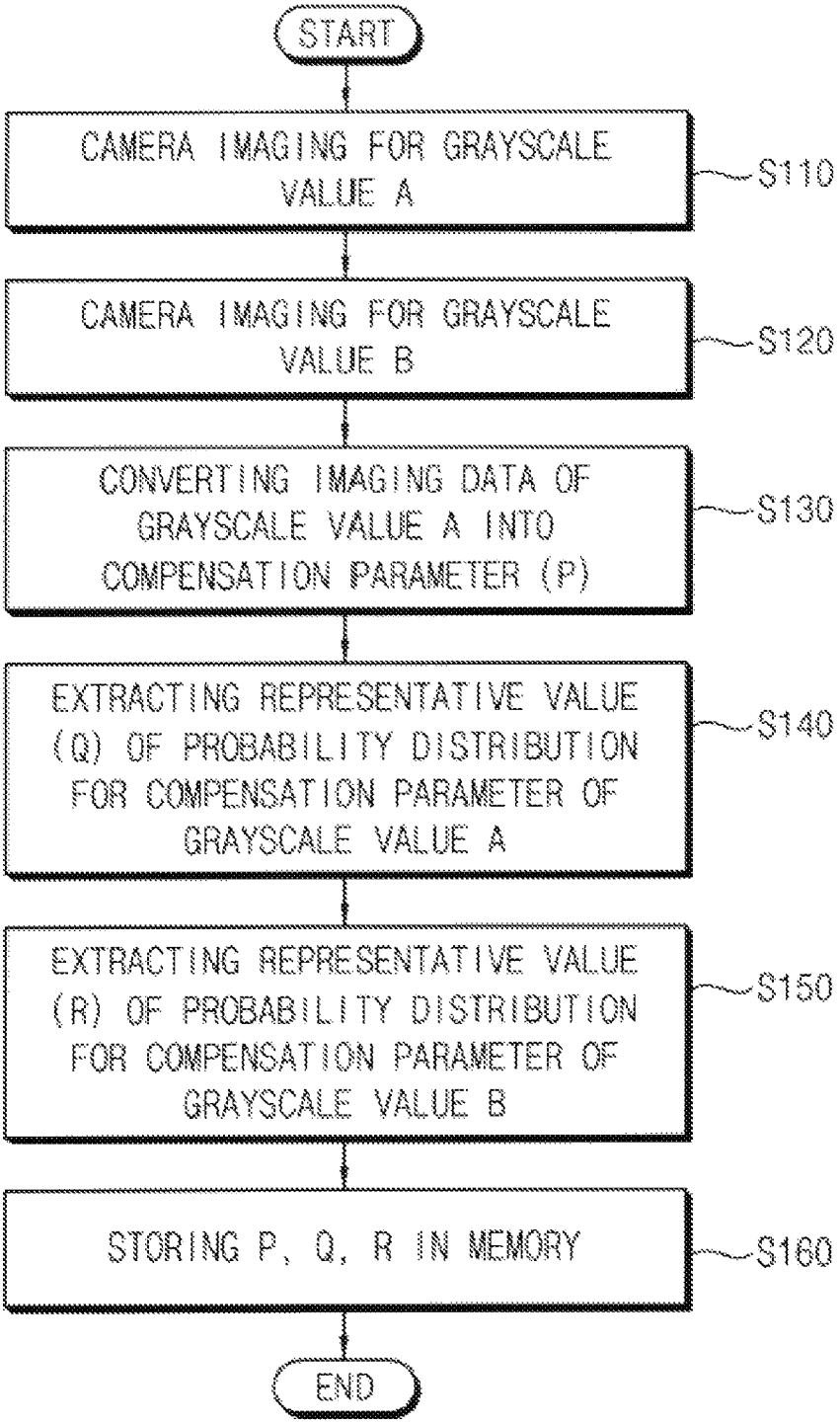
FIG. 2 is a flowchart illustrating a method of compensating a stain of a display panel of FIG. 1.
Figure 3:
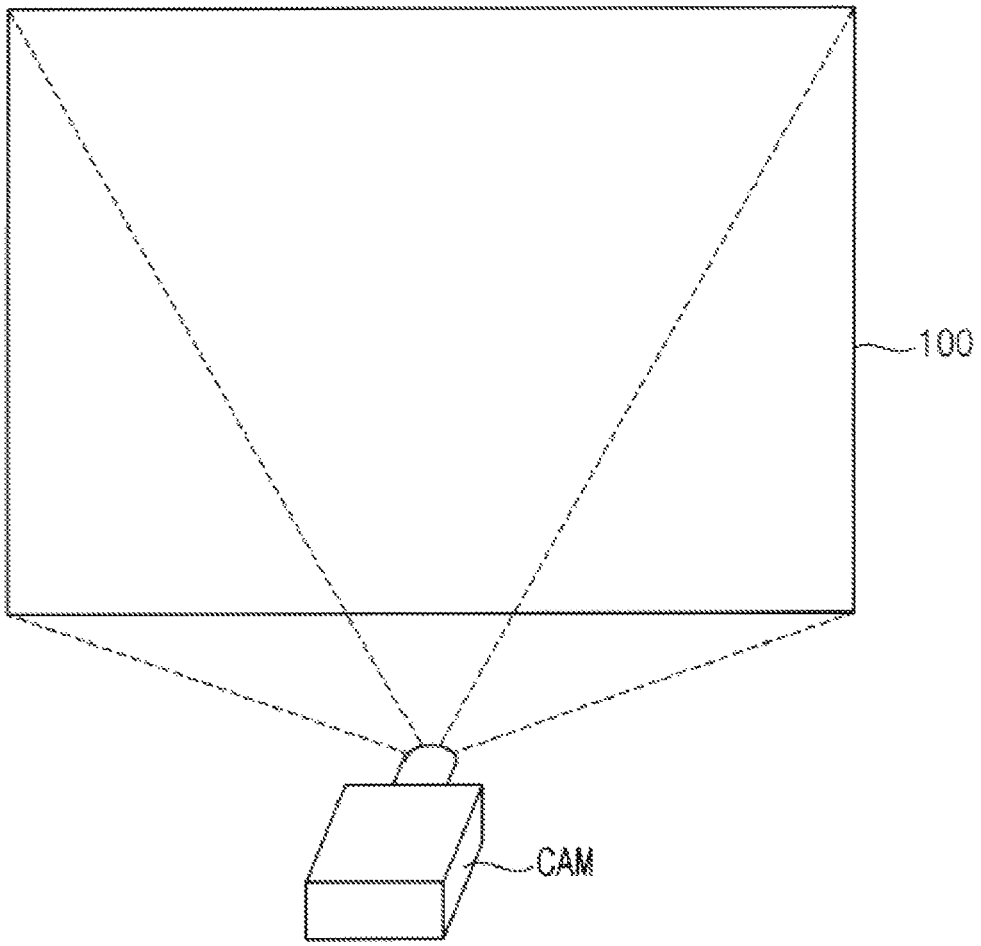
FIG. 3 is a conceptual diagram illustrating steps S110 and S120 of FIG. 2.

FIG. 2 is a flowchart illustrating a method of compensating a stain of a display panel of FIG. 1. FIG. 3 is a conceptual diagram illustrating steps S110 and S120 of FIG. 2.

Referring to FIGS. 1 to 3, all the pixels in the display panel 100 may display an image of a grayscale value A and the image having the grayscale value A on the display panel 100 may be imaged with a camera CAM (step S110). All the pixels in the display panel 100 may display an image of a grayscale value B and the image having the grayscale value B on the display panel 100 may be imaged with the camera CAM (step S120). Herein, the grayscale value B may be greater than the grayscale value A.

A compensation parameter (a value P) for each pixel in the display panel 100 is determined using the imaged grayscale value A. The compensation parameter (the value P) for the each pixel may be determined. The compensation parameter (the value P) may be determined to decrease differences in luminance between pixels in the grayscale A (step S130).

A representative value (a value Q) of a probability distribution of the compensation parameters (P) of the grayscale value A may be extracted from the imaged data of the grayscale value A (step S140). Herein, the representative value (the value Q) of the probability distribution of the compensation parameters of the grayscale value A may be an average of the compensation parameters of the grayscale value A and a standard deviation of the compensation parameters of the grayscale value A.

A compensation parameter for each pixel in the display panel 100 is determined using the imaged grayscale value B. The compensation parameter for the each pixel in the grayscale B may be determined. The compensation parameter is determined to decrease differences in luminance between pixels.

A representative value (a value R) of a probability distribution of compensation parameters of the grayscale value B may be extracted from the imaged data of the grayscale value B (step S150). Herein, the representative value (the value R) of the probability distribution of the compensation parameters of the grayscale value B may be an average of the compensation parameters of the grayscale value B and a standard deviation of the compensation parameters of the grayscale value B.

The input image data IMG may be compensated using the value P, the value Q and the value R. The value P, the value Q and the value R may be stored in a memory of the driving controller 200 (step S160). The compensation parameter for each pixel in the display panel 100 for the imaged grayscale value B is not stored in the memory of the driving controller 200 to save memory space in the memory.

The steps S110 to S160 may be performed prior to a normal driving of the display panel 100.

Figure 4:
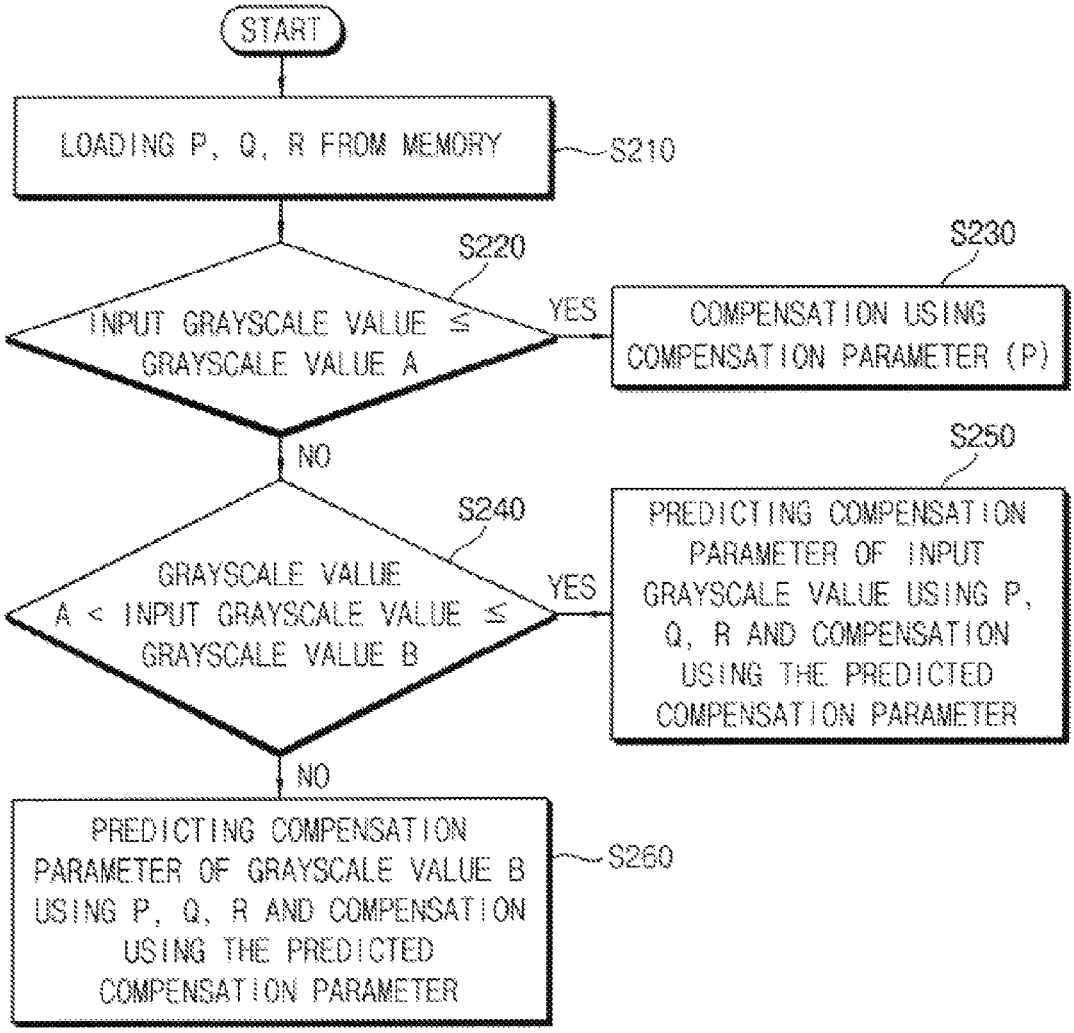
FIG. 4 is a flowchart illustrating a method of compensating a stain of a display panel of FIG. 1.
Figure 5:
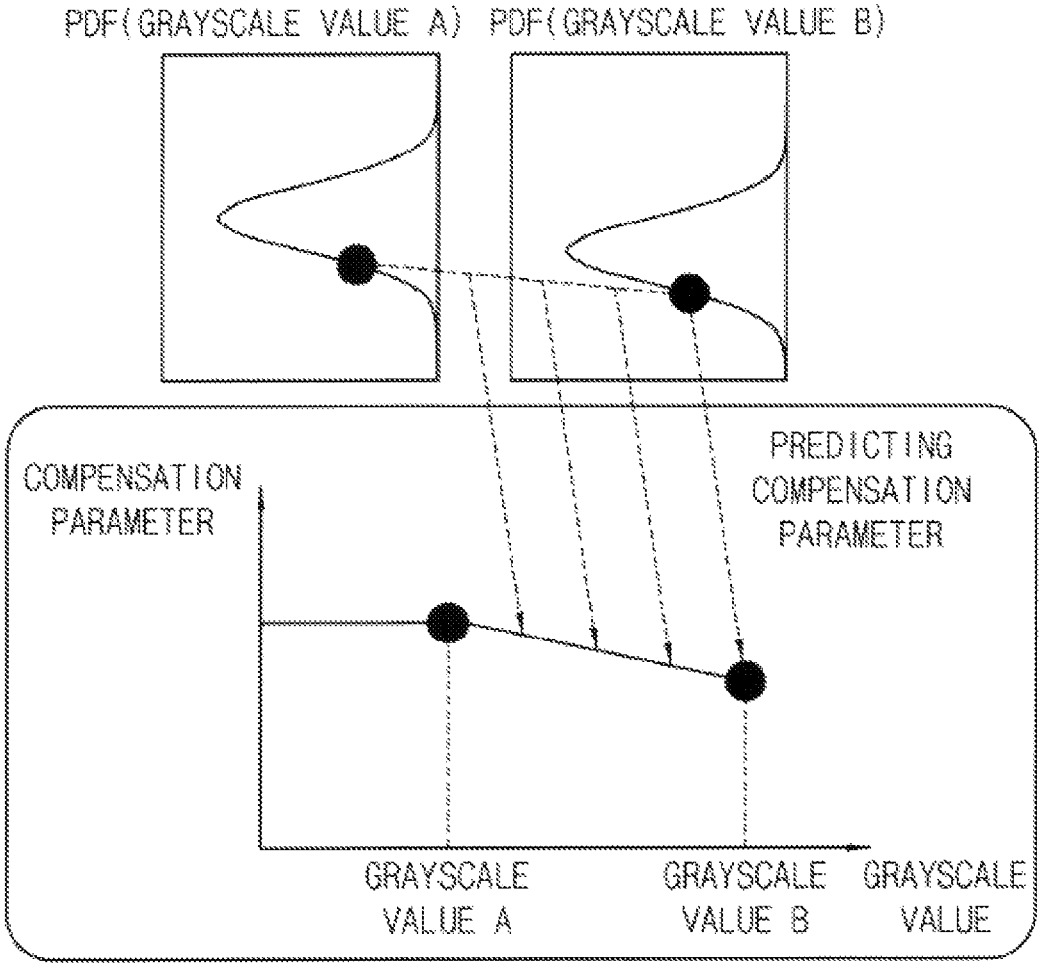
FIG. 5 is a conceptual diagram illustrating steps S250 of FIG. 4.
Figure 6:
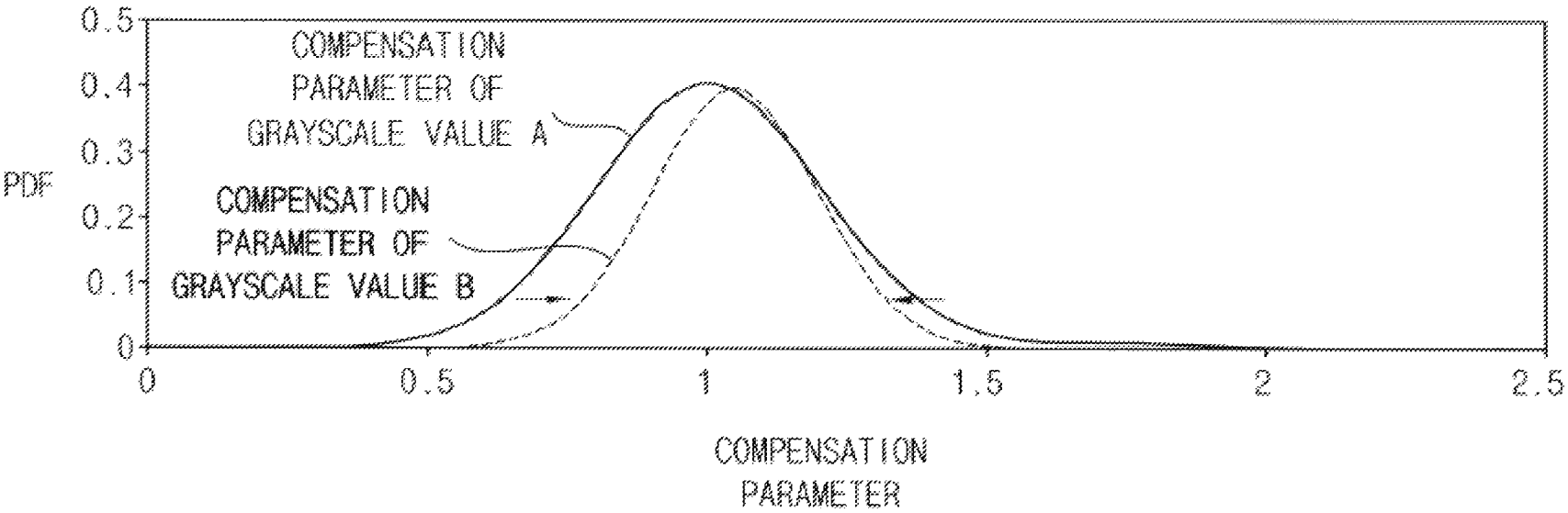
FIG. 6 is a graph illustrating a probability density function of a compensation parameter when an image having a grayscale value A is displayed on the display panel of FIG. 1 and a probability density function of a compensation parameter when an image having a grayscale value B is displayed on the display panel of FIG. 1.
Figure 7:
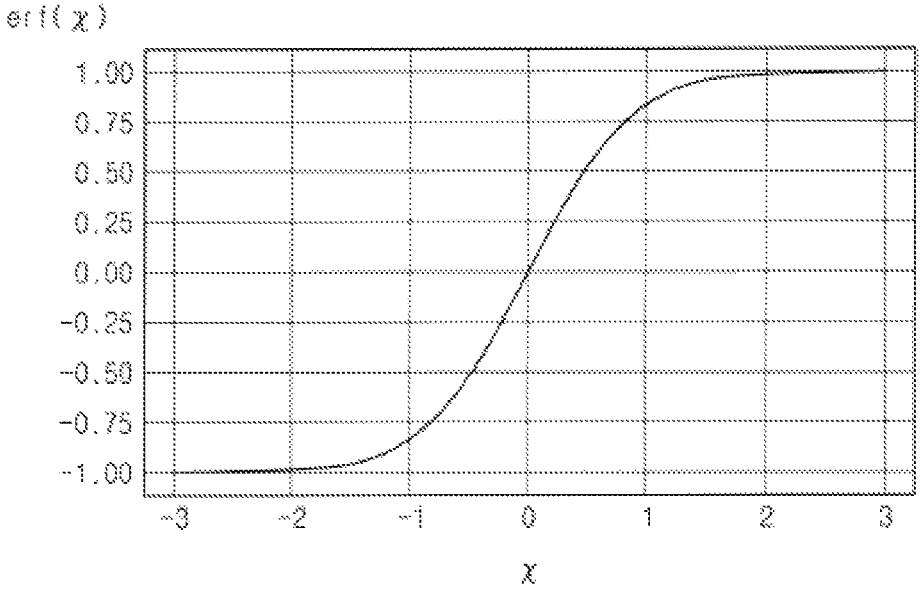
FIG. 7 is a graph illustrating an error function of the compensation parameter when the image having the grayscale value A is displayed on the display panel of FIG. 1.
Figure 8:
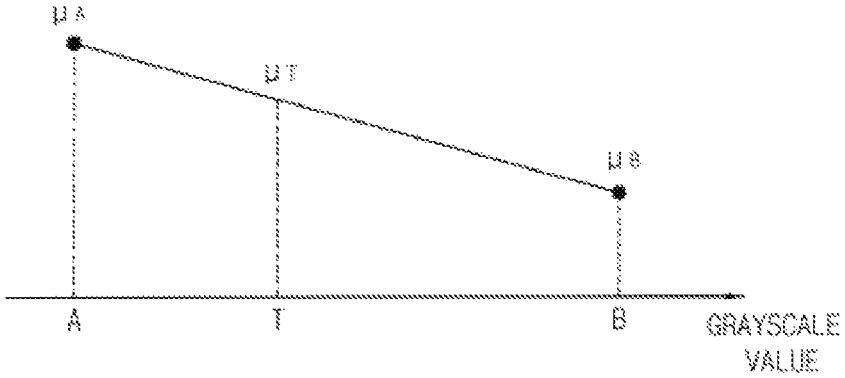
FIG. 8 is a graph illustrating an average of compensation parameters of a grayscale value T when the image having the grayscale value T is displayed on the display panel of FIG. 1.
Figure 9:
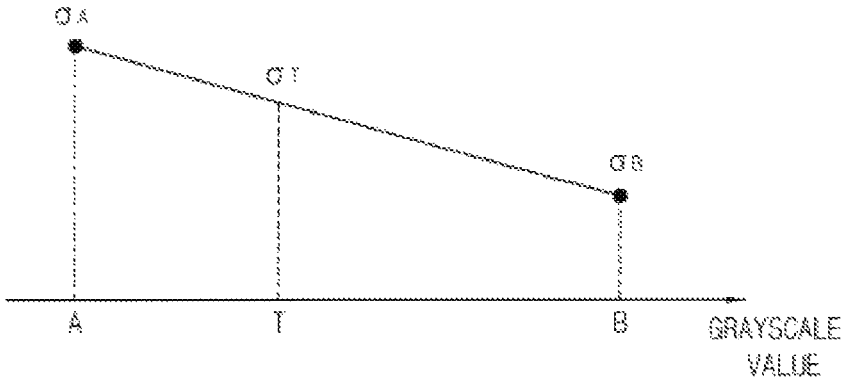
FIG. 9 is a graph illustrating a standard deviation of the compensation parameters of the grayscale value T when the image having the grayscale value T is displayed on the display panel of FIG. 1.
Figure 10:
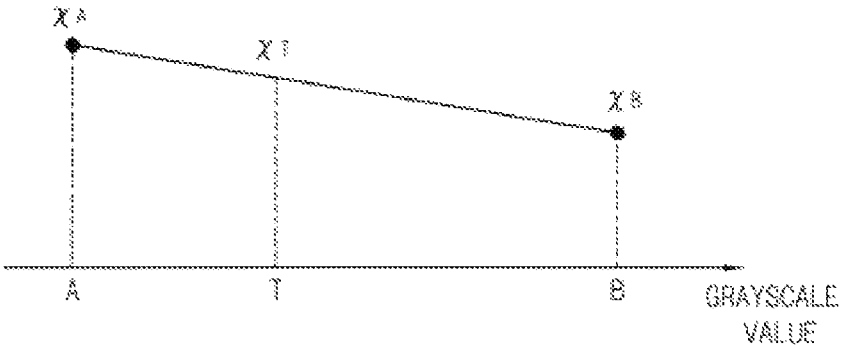
FIG. 10 is a graph illustrating the compensation parameter of the grayscale value T when the image having the grayscale value T is displayed on the display panel of FIG. 1.

FIG. 4 is a flowchart illustrating a method of compensating the stain of the display panel 100 of FIG. 1. FIG. 5 is a conceptual diagram illustrating steps S250 of FIG. 4. FIG. 6 is a graph illustrating a probability density function of the compensation parameter when the image having the grayscale value A is displayed on the display panel 100 of FIG. 1 and a probability density function of the compensation parameter when an image having the grayscale value B is displayed on the display panel 100 of FIG. 1. FIG. 7 is a graph illustrating an error function of the compensation parameter when the image having the grayscale value A is displayed on the display panel 100 of FIG. 1. FIG. 8 is a graph illustrating an average of compensation parameters of a grayscale value T when the image having the grayscale value T is displayed on the display panel 100 of FIG. 1. FIG. 9 is a graph illustrating a standard deviation of the compensation parameters of the grayscale value T when the image having the grayscale value T is displayed on the display panel 100 of FIG. 1. FIG. 10 is a graph illustrating the compensation parameter of the grayscale value T when the image having the grayscale value T is displayed on the display panel 100 of FIG. 1.

Referring to FIGS. 1 to 10, when the display apparatus is turned on, the driving controller 200 may load the value P for each pixel in the display panel 100, the value Q and the value R from the memory (step S210).

When an input grayscale value of the input image data IMG for a pixel is equal to or less than the grayscale value A (step S220), the input image data IMG may be compensated using the value P (steps S230).

When the input grayscale value of the input image data IMG for a pixel is greater than the grayscale value A and equal to or less than the grayscale value B (step S240), a compensation parameter for the input grayscale value for the pixel may be predicted using the value P, the value Q and the value R, and the input grayscale value may be compensated using the predicted compensation parameter for the pixel (step S250).

When the input grayscale value of the input image data IMG for a pixel is greater than the grayscale value B, a compensation parameter of the grayscale value B may be predicted using the value P, the value Q and the value R, and the input grayscale value may be compensated using the predicted compensation parameter of the grayscale value B (step S260).

The steps S210 to S260 may be performed in the normal driving of the display panel 100.

As shown in FIG. 5, the probability density function (PDF) of the compensation parameters of the grayscale value A may be compared to the probability density function (PDF) of the predicted compensation parameters of the grayscale value B in the step of compensating the input image data IMG.

All of the compensation parameters of the grayscale value A are stored in the memory. In contrast, the compensation parameters of the grayscale value B are not stored in the memory. Instead, the representative value Q (e.g., the average and the standard deviation) of the probability distribution of the compensation parameters of the grayscale value A and the representative value R (e.g., the average and the standard deviation) of the probability distribution of the compensation parameters of the grayscale value B are stored in the memory. The compensation parameter of the grayscale value B may be predicted using the compensation parameter P of the grayscale value A, the representative value Q of the probability distribution of the compensation parameters of the grayscale value A and the representative value R of the probability distribution of the compensation parameters of the grayscale value B.

In FIG. 6, examples of the probability density function of the compensation parameters of the grayscale value A and the probability density function of the compensation parameters of the grayscale value B are illustrated. In FIG. 6, when the compensation parameter is 1, the input grayscale value may not be compensated. When the compensation parameter is 1.1, the input grayscale value of 100 may be compensated to 110. The pixel having the compensation parameter greater than 1, for example, 1.1, may be relatively dark so that the pixel having the compensation parameter of 1.1 may be compensated to be brighter. When the compensation parameter is less than 1.0, for example, 0.9, the input grayscale value of 100 may be compensated to 90. The pixel having the compensation parameter of 0.9 may be relatively bright so that the pixel having the compensation parameter of 0.9 may be compensated to be darker. The probability density function of the compensation parameters of the grayscale value A may be represented as following Equation 1 and the probability density function of the compensation parameters of the grayscale value B may be represented as following Equation 2. Herein, the average of the compensation parameters of the grayscale value A is $\mu A$, the standard deviation of the compensation parameters of the grayscale value A is $\sigma A$, the average of the compensation parameters of the grayscale value B is $\mu B$ and the standard deviation of the compensation parameters of the grayscale value B is $\sigma B$.

$$f_A(x) = \frac{1}{\sigma_A\sqrt{2\pi}}\exp\left(-\frac{(x-\mu_A)^2}{2\sigma_A^2}\right) \quad \text{[Equation 1]}$$

$$f_B(x) = \frac{1}{\sigma_B\sqrt{2\pi}}\exp\left(-\frac{(x-\mu_B)^2}{2\sigma_B^2}\right) \quad \text{[Equation 2]}$$

To predict the compensation parameter of the grayscale value B using the compensation parameter (the value P) of the grayscale value A, the representative (the value Q) of the probability distribution of the compensation parameters of the grayscale value A and the representative (the value R) of the probability distribution of the compensation parameters of the grayscale value B, a cumulative distribution function (CDF) of the compensation parameters of the grayscale value A and a cumulative distribution function (CDF) of the compensation parameters of the grayscale value B may be compared. The cumulative distribution function (CDF) of the compensation parameters of the grayscale value A is an integral of the probability density function (PDF) of the compensation parameters of the grayscale value A. The cumulative distribution function (CDF) of the compensation parameters of the grayscale value A may be represented as following Equation 3. The cumulative distribution function (CDF) of the compensation parameters of the grayscale value B is an integral of the probability density function (PDF) of the compensation parameters of the grayscale value B. The cumulative distribution function (CDF) of the compensation parameters of the grayscale value B may be represented as following Equation 4.

$$F_A(x) = \int_{-\infty}^{x} f_A(t)dt = \int_{-\infty}^{x}\frac{1}{\sigma_A\sqrt{2\pi}}\exp\left(-\frac{(t-\mu_A)^2}{2\sigma_A^2}\right)dt = \frac{1}{2}\left[1+\mathrm{erf}\left(\frac{x-\mu_A}{\sigma_A\sqrt{2}}\right)\right] \quad \text{[Equation 3]}$$

$$F_B(x) = \int_{-\infty}^{x} f_B(t)dt = \int_{-\infty}^{x}\frac{1}{\sigma_B\sqrt{2\pi}}\exp\left(-\frac{(t-\mu_B)^2}{2\sigma_B^2}\right)dt = \frac{1}{2}\left[1+\mathrm{erf}\left(\frac{x-\mu_B}{\sigma_B\sqrt{2}}\right)\right] \quad \text{[Equation 4]}$$

An error function erf in Equations 3 and 4 may be defined as following Equation 5. The error function erf is illustrated as a graph in FIG. 7.

$$\mathrm{erf}(x) \equiv \frac{2}{\sqrt{\pi}}\int_0^x \exp(-t^2)dt \quad \text{[Equation 5]}$$

Suppose that the cumulative distribution function (CDF) of the compensation parameter of the grayscale value A is same as the cumulative distribution function (CDF) of the compensation parameter of the grayscale value B to predict the compensation parameter of the grayscale value B using the compensation parameter (the value P) of the grayscale value A, the representative (the value Q) of the probability distribution of the compensation parameters of the grayscale value A and the representative (the value R) of the probability distribution of the compensation parameters of the grayscale value B, then following Equation 6 is obtained and finally Equation 7 is obtained from Equation 6.

$$\mathrm{erf}\left(\frac{xA-\mu A}{\sigma A\sqrt{2}}\right) = \mathrm{erf}\left(\frac{xB-\mu B}{\sigma B\sqrt{2}}\right) \quad \text{[Equation 6]}$$

$$xB = \left(\frac{xA-\mu A}{\sigma A}\right)\sigma B + \mu B \quad \text{[Equation 7]}$$

In Equation 7, the compensation parameter of the grayscale value A is xA and the predicted compensation parameter of the grayscale value B is xB.

When the input grayscale value is T, the compensation parameter of the grayscale value T may be predicted by comparing the probability density function of the compensation parameters of the grayscale value A and a probability density function of compensation parameters of the grayscale value T.

When the compensation parameter of the grayscale value A is xA, an average of the compensation parameters of the grayscale value A is μA, a standard deviation of the compensation parameters of the grayscale value A is σA, an average of the compensation parameters of the grayscale value T is μT, a standard deviation of the compensation parameters of the grayscale value T is σT and the predicted compensation parameter of the input grayscale value is xT, Equation 8 is satisfied.

$$xT = \left(\frac{xA-\mu A}{\sigma A}\right)\sigma T + \mu T \quad \text{[Equation 8]}$$

As shown in FIG. 8, the average μT of the compensation parameters of the grayscale value T may be determined by linear interpolation of the average μA of the compensation parameters of the grayscale value A and the average μB of the compensation parameters of the grayscale value B.

As shown in FIG. 9, the standard deviation σT of the compensation parameters of the grayscale value T may be determined by linear interpolation of the standard deviation σA of the compensation parameters of the grayscale value A and the standard deviation σB of the compensation parameters of the grayscale value B.

For example, the compensation parameter xT of the grayscale value T may be predicted using the average μT of the compensation parameters of the grayscale value T and the standard deviation σT of the compensation parameters of the grayscale value T as explained referring to Equation 8 and FIGS. 8 and 9.

Alternatively, the compensation parameter xT of the grayscale value T may be obtained by linear interpolation of the compensation parameter xA of the grayscale value A and the compensation parameter xB of the grayscale value B as shown in FIG. 10.

In the present example embodiment, by assuming that the compensation parameter placed in a lower 20% of the cumulative distribution function of the grayscale value A is also placed in a lower 20% of the cumulative distribution function of the grayscale value B, the compensation parameter of the grayscale value B may be predicted using the compensation parameter P of the grayscale value A, the representative value Q of the probability distribution of the compensation parameters of the grayscale value A and the representative value R of the probability distribution of the compensation parameters of the grayscale value B.

Similarly, by assuming that the compensation parameter placed in an upper 40% of the cumulative distribution function of the grayscale value A is also placed in an upper 40% of the cumulative distribution function of the grayscale value B, the compensation parameter of the grayscale value B may be predicted using the compensation parameter P of the grayscale value A, the representative value Q of the probability distribution of the compensation parameters of the grayscale value A and the representative value R of the probability distribution of the compensation parameters of the grayscale value B.

When the input grayscale value is between the grayscale value A and the grayscale value B, the compensation value of the input grayscale value may be determined by linear interpolation of the compensation parameter of the grayscale value A and the compensation parameter of the grayscale value B.

Figure 11:
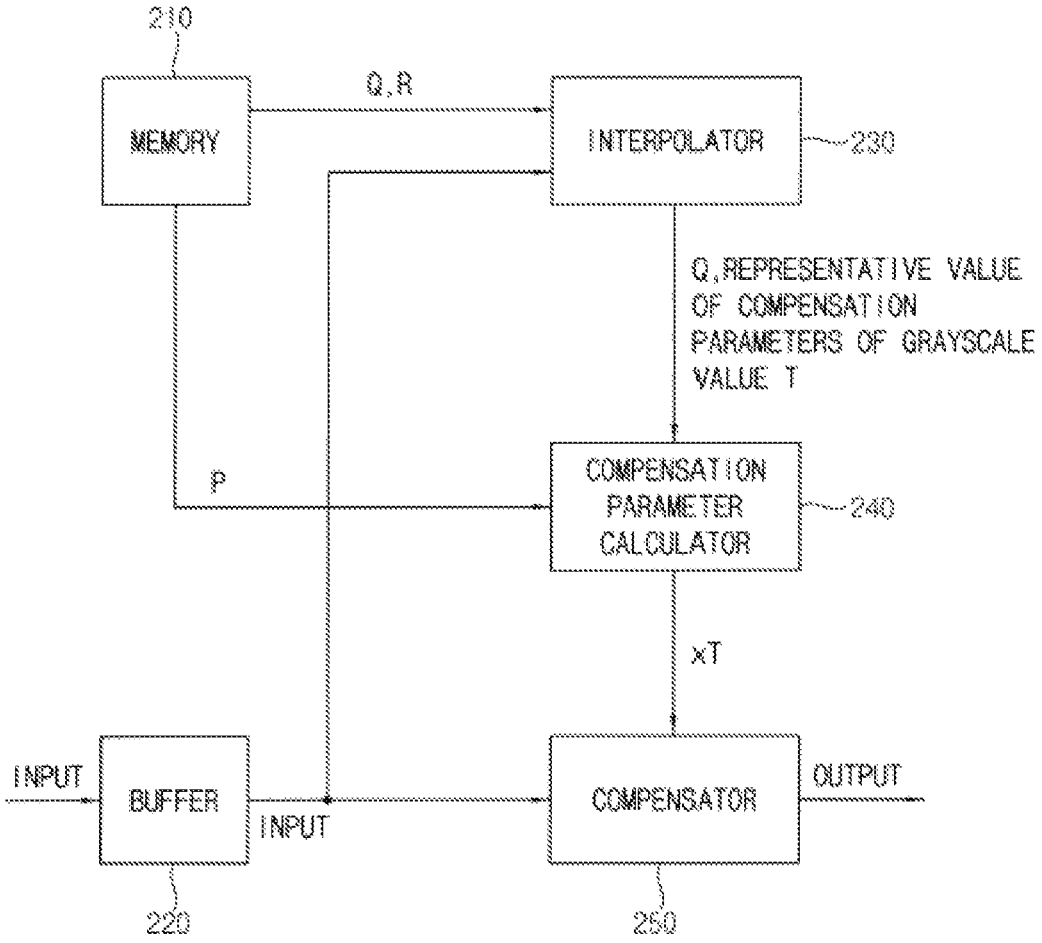
FIG. 11 is a block diagram illustrating a driving controller of FIG. 1.

FIG. 11 is a block diagram illustrating the driving controller 200 of FIG. 1.

Referring to FIGS. 1 to 11, the driving controller 200 may compensate the input image data INPUT using the compensation parameter P of the image having the grayscale value A, the representative value Q of the probability distribution of the compensation parameters of the grayscale value A and the representative value R of the probability distribution of the compensation parameters of the grayscale value B to generate the data signal OUTPUT.

The driving controller 200 may include a memory 210, a buffer 220, an interpolator 230, a compensation parameter calculator 240 and a compensator 250.

The memory 210 may store the value P, the value Q and the value R.

The buffer 220 may buffer the input image data INPUT and output the input image data INPUT to the interpolator 230 and the compensator 250.

The interpolator 230 may receive the value Q and the value R from the memory 210 and output the value Q and a representative value of probability distribution of compensation parameters of the grayscale value T.

The compensation parameter calculator 240 may predict a compensation parameter xT of the grayscale value T using the value P, the value Q and the representative value of probability distribution of compensation parameters of the grayscale value T. The compensation parameter calculator 240 may predict the compensation parameter xT of the grayscale value T using Equation 8.

The compensator 250 may compensate the input image data IMG using the compensation parameter xT of the grayscale value T.

According to the present example embodiment, the input grayscale value of the input image data IMG may be compensated using the compensation parameter P of the image having the grayscale value A, the representative value Q of the probability distribution of the compensation parameters of the grayscale value A and the representative value R of the probability distribution of the compensation parameters of the grayscale value B. The compensation parameters of grayscale value B may not be directly stored in the memory but the representative value of the compensation parameters of grayscale value B may be stored in the memory so that the accuracy of the stain compensation may be enhanced without significantly increasing the capacity of the memory.

Figure 12:
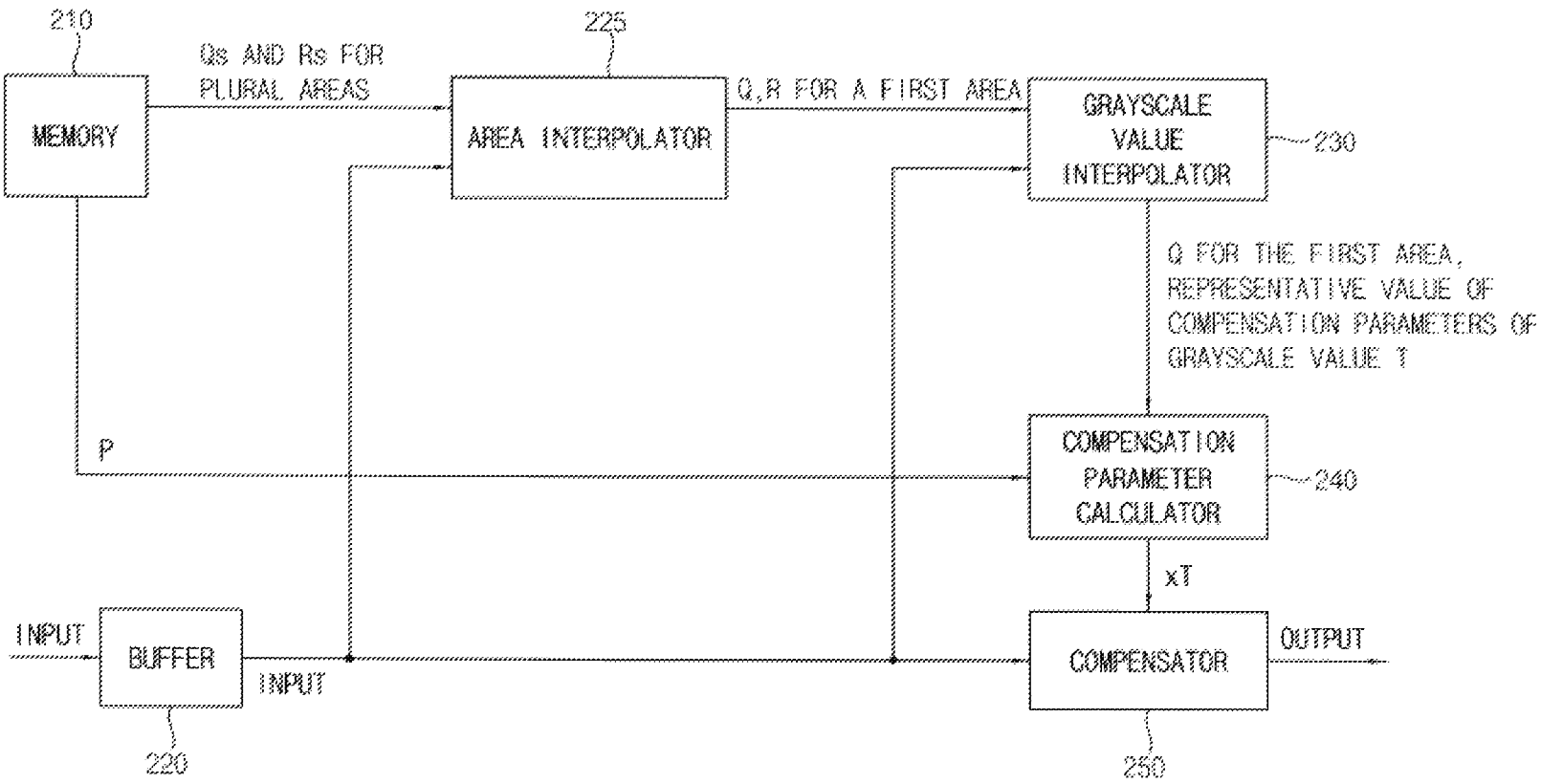
FIG. 12 is a block diagram illustrating a driving controller of a display apparatus according to an example embodiment of the present inventive concept.
Figure 13:
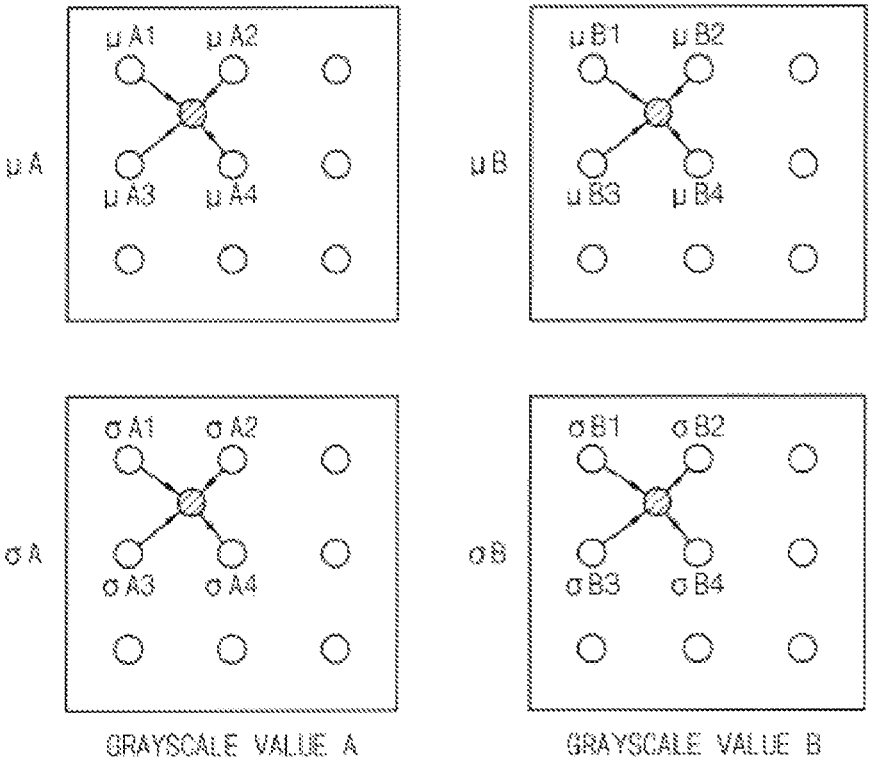
FIG. 13 is a conceptual diagram illustrating an operation of an area interpolator of FIG. 12.

FIG. 12 is a block diagram illustrating a driving controller of a display apparatus according to an example embodiment of the present inventive concept. FIG. 13 is a conceptual diagram illustrating an operation of an area interpolator of FIG. 12.

The method of compensating the stain of the display panel, the method of driving the display panel and the display apparatus according to the present example embodiment is substantially the same as the method of compensating the stain of the display panel, the method of driving the display panel and the display apparatus of the previous example embodiment explained referring to FIGS. 1 to 11 except that the display panel includes a plurality of areas and values Rs and values Qs for the respective areas are used to compensate the input image data. Thus, the same reference numerals will be used to refer to the same or like parts as those described in the previous example embodiment of FIGS. 1 to 12 and any repetitive explanation concerning the above elements will be omitted.

Referring to FIGS. 1 to 10, 12 and 13, the display apparatus includes a display panel 100 and a display panel driver. The display panel driver includes a driving controller 200, a gate driver 300, a gamma reference voltage generator 400 and a data driver 500.

When the display apparatus is turned on, the driving controller 200 may load the value P, the value Q and the value R from the memory (step S210).

When an input grayscale value of the input image data IMG is equal to or less than the grayscale value A (step S220), the input image data IMG may be compensated using the value P (steps S230).

When the input grayscale value of the input image data IMG is greater than the grayscale value A and equal to or less than the grayscale value B (step S240), a compensation parameter for the input grayscale value may be predicted using the value P, the value Q and the value R and the input grayscale value may be compensated using the predicted compensation parameter (step S250).

When the input grayscale value of the input image data IMG is greater than the grayscale value B, the compensation parameter of the grayscale value B may be predicted using the value P, the value Q and the value R and the input grayscale value may be compensated using the predicted compensation parameter (step S260).

Herein, in the step S260, the input grayscale value may be compensated using the values Qs corresponding to a plurality of areas and the values Rs corresponding to the plurality of areas.

The value Q of a first position in the display panel 100 may be determined by interpolating the values Qs of the areas adjacent to the first position. The value Q may be the average and the standard deviation of the compensation parameters of the grayscale value A.

For example, an average μA of the compensation parameters of the grayscale value A of the first position in the display panel 100 may be generated by spatially interpolating averages μA1, μA2, μA3 and μA4 of the compensation parameters of the grayscale value A of the areas adjacent to the first position. For example, a standard deviation σA of the compensation parameters of the grayscale value A of the first position in the display panel 100 may be generated by spatially interpolating standard deviations σA1, σA2, σA3 and σA4 of the compensation parameters of the grayscale value A of the areas adjacent to the first position.

The value R of the first position in the display panel 100 may be determined by interpolating the values Rs of the areas adjacent to the first position. The value R may be the average and the standard deviation of the compensation parameters of the grayscale value B.

For example, an average μB of the compensation parameters of the grayscale value A of the first position in the display panel 100 may be generated by spatially interpolating averages μB1, μB2, μB3 and μB4 of the compensation parameters of the grayscale value B of the areas adjacent to the first position. For example, a standard deviation σB of the compensation parameters of the grayscale value B of the first position in the display panel 100 may be generated by spatially interpolating standard deviations σB1, σB2, σB3 and σB4 of the compensation parameters of the grayscale value B of the areas adjacent to the first position.

The driving controller 200 may compensate the input image data INPUT using the compensation parameter P of the image having the grayscale value A, the representative value Q of the probability distribution of the compensation parameters of the grayscale value A and the representative value R of the probability distribution of the compensation parameters of the grayscale value B to generate the data signal OUTPUT.

The driving controller 200 may include a memory 210, a buffer 220, an area interpolator 225, a grayscale value interpolator 230, a compensation parameter calculator 240 and a compensator 250.

The memory 210 may store the value P, the values Qs corresponding to the areas and the values Rs corresponding to the areas.

The buffer 220 may buffer the input image data INPUT and output the input image data INPUT to the area interpolator 225, the grayscale value interpolator 230 and the compensator 250.

The area interpolator 225 may receive the values Qs and the values Rs for plural areas from the memory 210 and output a value Q of the first position and a value R of the first position to the grayscale value interpolator.

The grayscale value interpolator 230 may receive the value Q of the first position and the value R of the first position from the area interpolator 225 and output the value Q of the first position and a representative value of probability distribution of compensation parameters of the grayscale value T.

The compensation parameter calculator 240 may predict a compensation parameter xT of the grayscale value T using the value P, the value Q of the first position and the representative value of probability distribution of compensation parameters of the grayscale value T. The compensation parameter calculator 240 may predict the compensation parameter xT of the grayscale value T using Equation 8.

The compensator 250 may compensate the input image data IMG using the compensation parameter xT of the grayscale value T.

According to the present example embodiment, the input grayscale value of the input image data IMG may be compensated using the compensation parameter P of the image having the grayscale value A, the representative value Q of the probability distribution of the compensation parameters of the grayscale value A and the representative value R of the probability distribution of the compensation parameters of the grayscale value B. The compensation parameters of grayscale value B may not be directly stored in the memory but the representative value of the compensation parameters of grayscale value B may be stored in the memory so that the accuracy of the stain compensation may be enhanced without significantly increasing the capacity of the memory.

According to the present example embodiment, the stain of the display panel may be effectively compensated without significantly increasing the capacity of the memory.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A method of displaying an image on a display panel, the method comprising:

displaying an image of a grayscale value A on the display panel;

imaging the image of the grayscale value A on the display panel with a camera;

displaying an image of a grayscale value B on the display panel;

imaging the image of the grayscale value B on the display panel with the camera;

determining a compensation parameter (a value P) of the grayscale value A for each pixel in the display panel using the imaged data of the grayscale value A;

determining a representative value (a value Q) of a probability distribution of the compensation parameters of the grayscale value A from the imaged data of the grayscale value A;

determining a representative value (a value R) of a probability distribution of compensation parameters of the grayscale value B from the imaged data of the grayscale value B; and compensating an input image data for each pixel using the value P, the value Q and the value R.

2. The method of claim 1, wherein, when an input grayscale value of the input image data is equal to or less than the grayscale value A, the input image data is compensated using the value P.

3. The method of claim 2, wherein, when the input grayscale value of the input image data is greater than the grayscale value A and equal to or less than the grayscale value B, a compensation parameter for the input grayscale value is predicted using the value P, the value Q and the value R, and the input image data is compensated using the predicted compensation parameter for the input grayscale value.

4. The method of claim 3, wherein, when the input grayscale value of the input image data is greater than the grayscale value B, the compensation parameter of the grayscale value B is predicted using the value P, the value Q and the value R and the input image data is compensated using the predicted compensation parameter of the grayscale value B.

5. The method of claim 1, wherein the value Q includes an average of the compensation parameters of the grayscale value A and a standard deviation of the compensation parameters of the grayscale value A.

6. The method of claim 5, wherein the value R includes an average of the compensation parameters of the grayscale value B and a standard deviation of the compensation parameters of the grayscale value B.

7. The method of claim 6, wherein the compensating the input image data comprises comparing a probability density function of the compensation parameters of the grayscale value A and a probability density function of the compensation parameters of a grayscale value T, when an input grayscale value of the input image data is the grayscale value T.

8. The method of claim 7, wherein, when the compensation parameter of the grayscale value A is xA, the average of the compensation parameters of the grayscale value A is μA, the standard deviation of the compensation parameters of the grayscale value A is σA, an average of the compensation parameters of the grayscale value T is μT, a standard deviation of the compensation parameters of the grayscale value T is σT and a predicted compensation parameter of the input grayscale value is xT, $$xT = \left(\frac{xA - \mu A}{\sigma A}\right)\sigma T + \mu T.$$

9. The method of claim 7, wherein an average of the compensation parameters of the grayscale value T is determined by interpolating the average of the compensation parameters of the grayscale value A and the average of the compensation parameters of the grayscale value B, and wherein a standard deviation average of the compensation parameters of the grayscale value T is determined by interpolating the standard deviation of the compensation parameters of the grayscale value A and the standard deviation of the compensation parameters of the grayscale value B.

10. The method of claim 7, wherein the compensation parameter of the grayscale value T is determined by interpolating the compensation parameter of the grayscale value A and the compensation parameter of the grayscale value B.

11. The method of claim 6, wherein the input image data is compensated using the value P, values Qs corresponding to a plurality of areas and values Rs corresponding to the plurality of the areas.

12. The method of claim 11, wherein the value Q of a first position in the display panel is determined by interpolating the values Qs of areas adjacent to the first position, and wherein the value R of the first position in the display panel is determined by interpolating the values Rs of the areas adjacent to the first position.

13. A method of driving a display panel, the method comprising:

compensating an input image data using a compensation parameter (a value P) of a grayscale value A, a representative value (a value Q) of a probability distribution of the compensation parameters of the grayscale value A and a representative value (a value R) of a probability distribution of compensation parameters of a grayscale value B to generate a data signal;

converting the data signal into a data voltage; and outputting the data voltage to the display panel.

14. The method of claim 13, wherein, when an input grayscale value of the input image data is equal to or less than the grayscale value A, the input image data is compensated using the value P.

15. The method of claim 14, wherein, when the input grayscale value of the input image data is greater than the grayscale value A and equal to or less than the grayscale value B, a compensation parameter for the input grayscale value is predicted using the value P, the value Q and the value R and the input image data is compensated using the predicted compensation parameter for the input grayscale value.

16. The method of claim 15, wherein, when the input grayscale value of the input image data is greater than the grayscale value B, the compensation parameter of the grayscale value B is predicted using the value P, the value Q and the value R and the input image data is compensated using the predicted compensation parameter of the grayscale value B.

17. A display apparatus comprising:

a display panel;

a driving controller configured to compensate an input image data using a compensation parameter (a value P) of a grayscale value A, a representative value (a value Q) of a probability distribution of the compensation parameters of the grayscale value A and a representative value (a value R) of a probability distribution of compensation parameters of a grayscale value B to generate a data signal; and a data driver configured to convert the data signal into a data voltage and output the data voltage to the display panel.

18. The display apparatus of claim 17, wherein the driving controller is configured to compare a probability density function of the compensation parameters of the grayscale value A and a probability density function of the compensation parameters of a grayscale value T, when an input grayscale value of the input image data is the grayscale value T.

19. The display apparatus of claim 18, wherein the driving controller comprises:

an interpolator configured to receive the value Q and the value R from a memory and output the value Q and a representative value of probability distribution of the compensation parameters of the grayscale value T;

a compensation parameter calculator configured to predict a compensation parameter of the grayscale value T using the value P, the value Q and the representative value of probability distribution of compensation parameters of the grayscale value T; and a compensator configured to compensate the input image data using the compensation parameter of the grayscale value T.

20. The display apparatus of claim 18, wherein the driving controller comprises:

an area interpolator configured to receive values Qs corresponding to a plurality of areas and values Rs corresponding to the plurality of the areas from a memory and determine the value Q of a first area in the display panel and the value R of the first area in the display panel;

a grayscale value interpolator configured to receive the value Q of the first area and the value R of the first area, and output the value Q of the first area and a representative value of the compensation parameters of the grayscale value T;

a compensation parameter calculator configured to predict a compensation parameter of the grayscale value T using the value P, the value Q of the first area and the representative value of compensation parameters of the grayscale value T; and a compensator configured to compensate the input image data using the compensation parameter of the grayscale value T.

* * * * *